US008006776B1

(12) United States Patent
Polsky

(10) Patent No.: US 8,006,776 B1
(45) Date of Patent: Aug. 30, 2011

(54) SLIDING PRESSURE CONTROL VALVE FOR PNEUMATIC HAMMER DRILL

(75) Inventor: Yarom Polsky, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 234 days.

(21) Appl. No.: 12/364,600

(22) Filed: Feb. 3, 2009

(51) Int. Cl.
*E21B 4/14* (2006.01)

(52) U.S. Cl. ..... 173/1; 173/13; 173/14; 173/15; 173/16; 173/17; 173/91; 173/178; 173/78; 173/80; 173/135; 173/136; 91/22; 91/325; 251/344; 251/348

(58) Field of Classification Search ..... 173/13–17, 173/91, 178, 78, 80, 135–136, 1; 91/222, 91/325; 251/344, 348
See application file for complete search history.

(56) References Cited

U.S. PATENT DOCUMENTS

| | | | | |
|---|---|---|---|---|
| 1,665,046 | A * | 4/1928 | Tucker | 173/127 |
| 1,687,317 | A * | 10/1928 | Archer | 417/117 |
| 2,071,204 | A * | 2/1937 | Hunt | 137/625.68 |
| 3,154,153 | A * | 10/1964 | Wilder et al. | 173/73 |
| 4,446,929 | A * | 5/1984 | Pillow | 173/17 |
| 5,085,284 | A | 2/1992 | Fu | |
| 5,301,761 | A | 4/1994 | Fu | |
| 5,715,897 | A * | 2/1998 | Gustafsson | 175/296 |
| 6,705,415 | B1 * | 3/2004 | Falvey et al. | 175/74 |
| 6,799,641 | B1 | 10/2004 | Lyon et al. | |
| 6,883,618 | B1 * | 4/2005 | Pascale | 173/91 |
| 7,422,074 | B2 | 9/2008 | Meneghini | |
| 2003/0047702 | A1 * | 3/2003 | Gunnarsson et al. | 251/297 |

* cited by examiner

*Primary Examiner* — Rinaldi I. Rada
*Assistant Examiner* — Michelle Lopez
(74) *Attorney, Agent, or Firm* — Olivia J. Tsai

(57) ABSTRACT

A pneumatic device control apparatus and method comprising a ported valve slidably fitted over a feed tube of the pneumatic device, and using a compliant biasing device to constrain motion of the valve to provide asymmetric timing for extended pressurization of a power chamber and reduced pressurization of a return chamber of the pneumatic device. The pneumatic device can be a pneumatic hammer drill.

21 Claims, 7 Drawing Sheets

SLIDING PRESSURE CONTROL VALVE FOR PNEUMATIC HAMMER DRILL

STATEMENT REGARDING FEDERALLY SPONSORED RESEARCH OR DEVELOPMENT

The Government has rights to this invention pursuant to Contract No. DE-AC04-94AL85000 awarded by the U.S. Department of Energy.

CROSS-REFERENCE TO RELATED APPLICATIONS

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention

Technical Field

The present invention relates to control of percussive hammer devices, such as pneumatic percussion drills and rock breakers.

A downhole pneumatic hammer is, in principle, a simple device consisting of a ported air feed conduit, more commonly known as a feed tube, check valve assembly above the feed tube to preventingress of wellbore fluids into the drill, a reciprocating piston, a case, a drill bit, and associated retaining hardware. The typical valveless device, for example, possesses on the order of 15 components. The reciprocation of the piston is accomplished by sequentially feeding high pressure air to either the power chamber of the case (the volume that when pressurized moves the piston towards the bit shank) or return chamber of the case. The regulation of the air flow can be accomplished either by use of passages (e.g., slots, grooves, ports) machined into the feed tube, piston body, or hammer case; or a combination of active valving and porting through either the piston, the case, or an additional sleeve.

However, existing designs do not provide the most efficient use of the total air energy available because they have built-in inherent inefficiencies. The present invention greatly reduces these inefficiencies.

BRIEF SUMMARY OF THE INVENTION

A pneumatic device control apparatus and method comprising a ported valve slidably fitted over a feed tube of the pneumatic device, and using a compliant biasing device to constrain motion of the valve to provide asymmetric timing for extended pressurization of a power chamber and reduced pressurization of a return chamber of the pneumatic device. The pneumatic device can be a pneumatic hammer drill.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
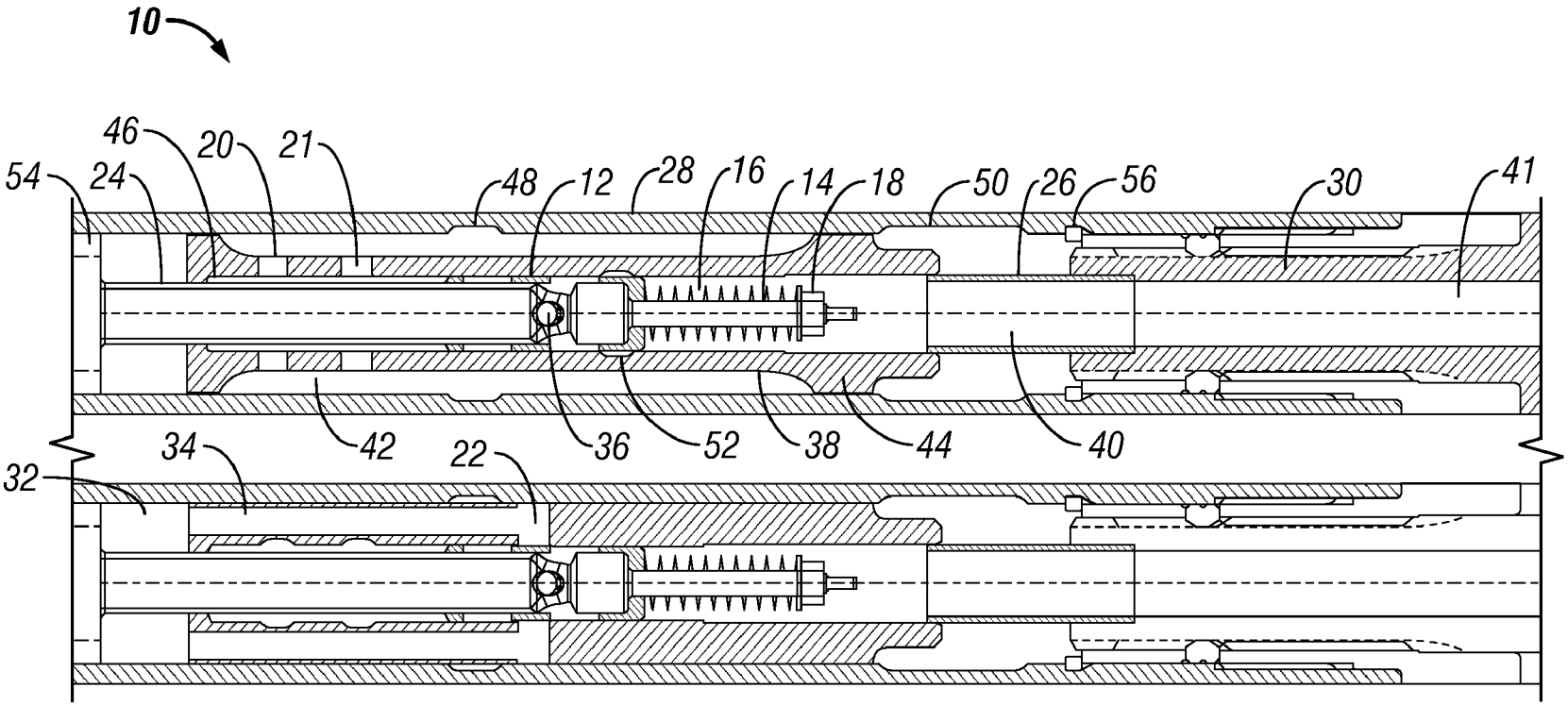
FIG. 1 is a paired opposing side cut-away view of the device of the invention.
Figure 2:
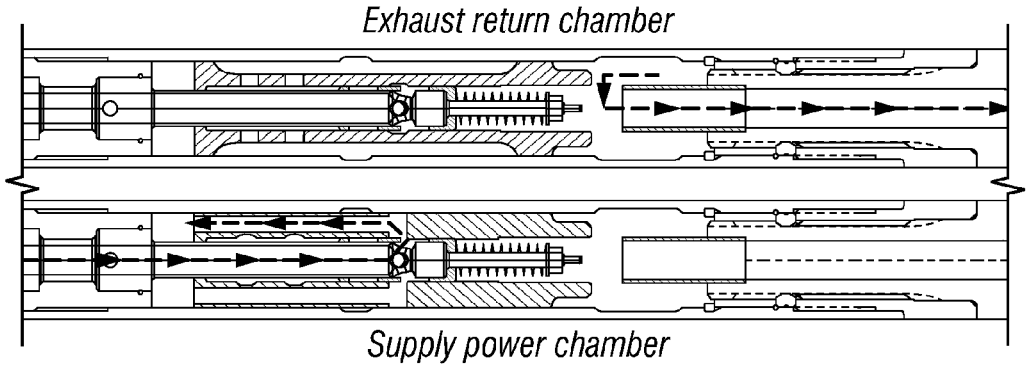
FIG. 2 is a paired opposing side cut-away view of the invention at begin power stroke state.
Figure 3:
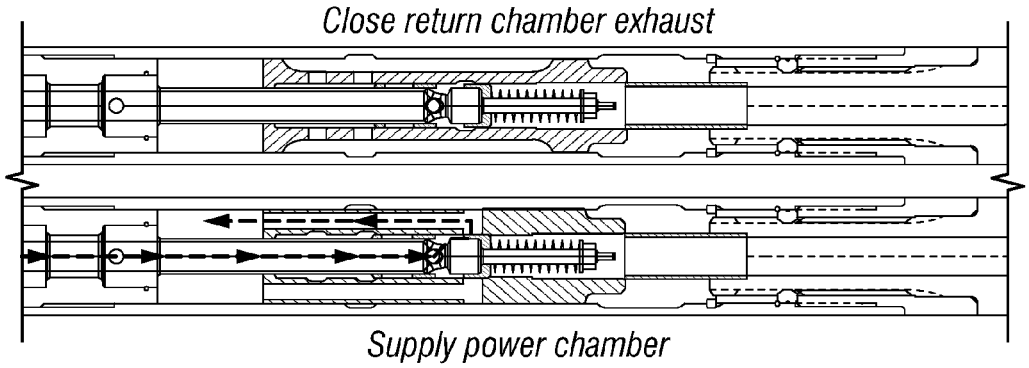
FIG. 3 is a paired opposing side cut-away view of the invention at close return chamber exhaust during power stroke state.
Figure 4:
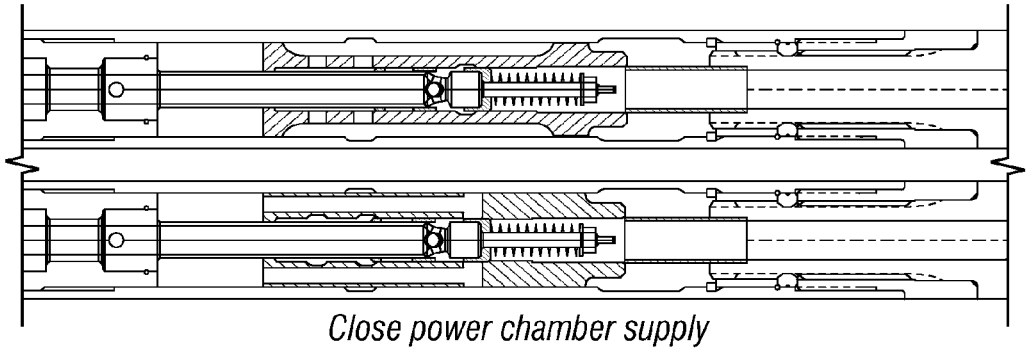
FIG. 4 is a paired opposing side cut-away view of the invention at close power chamber supply during power stroke state.
Figure 5:
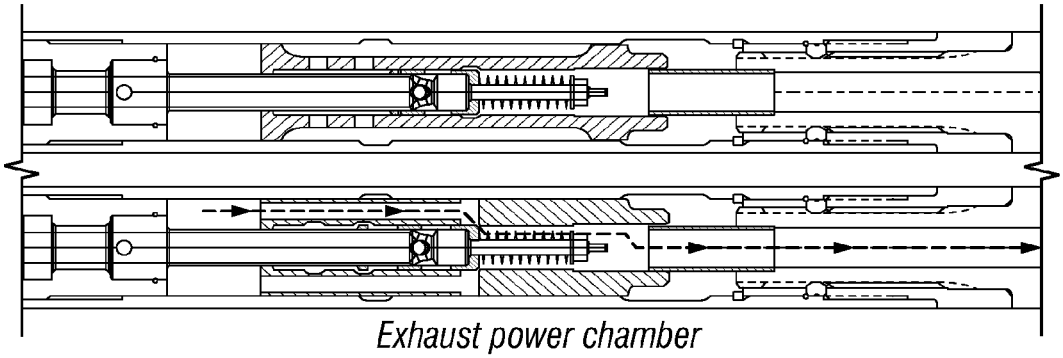
FIG. 5 is a paired opposing side cut-away view of the invention at begin power chamber exhaust during power stroke state.
Figure 6:
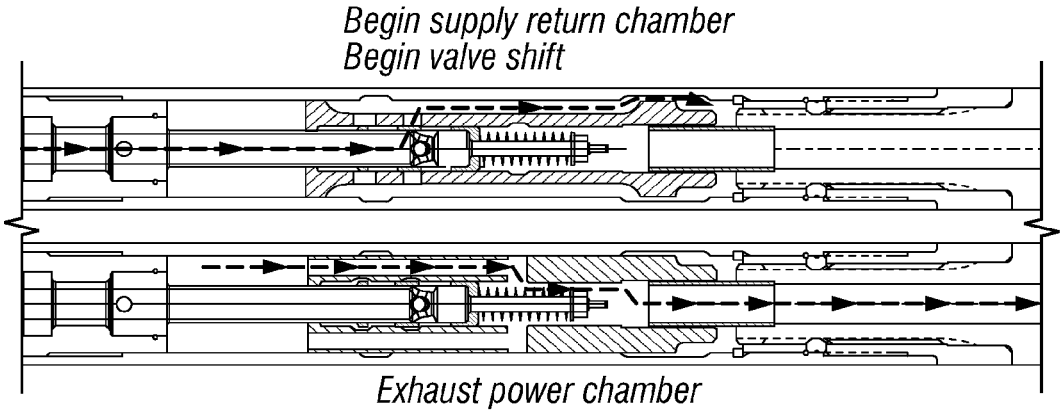
FIG. 6 is a paired opposing side cut-away view of the invention at begin return chamber supply and valve shift during power stroke state.
Figure 7:
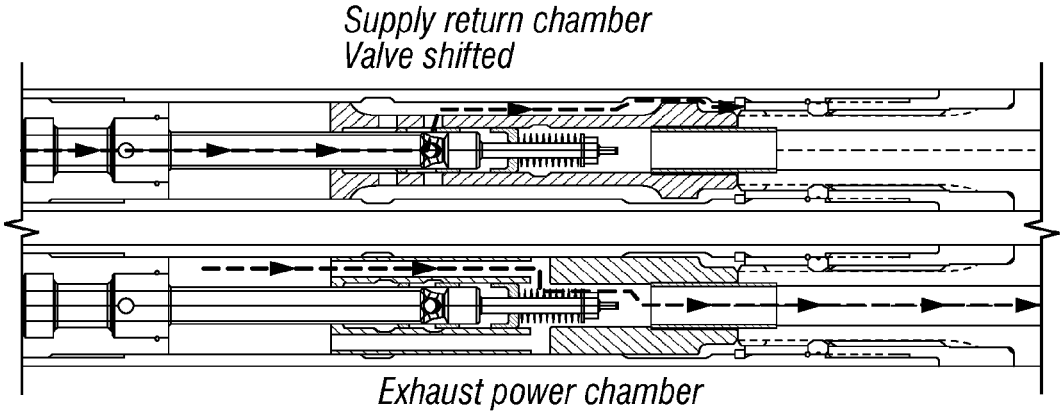
FIG. 7 is a paired opposing side cut-away view of the invention at bit strike.
Figure 8:
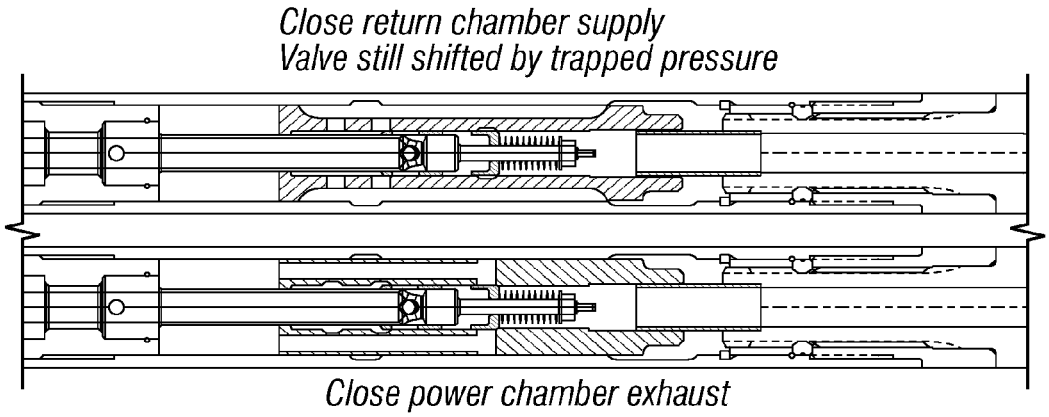
FIG. 8 is a paired opposing side cut-away view of the invention at close return pressure supply and power chamber exhaust during return stroke state.
Figure 9:
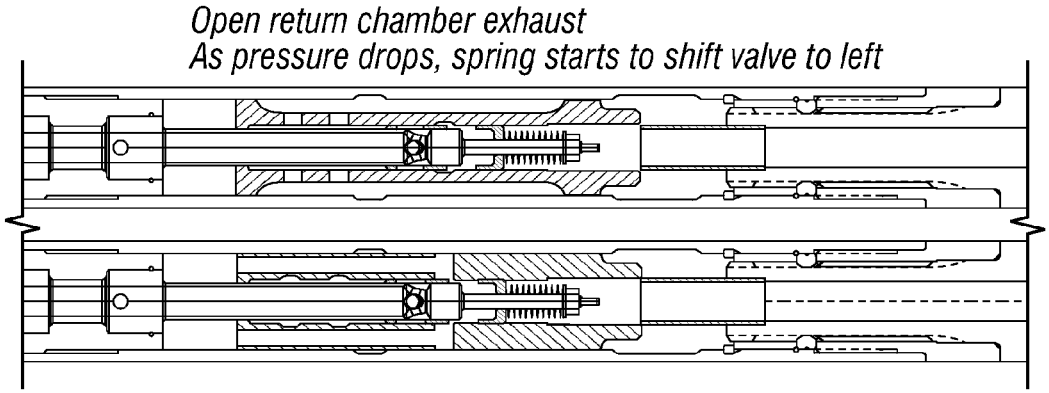
FIG. 9 is a paired opposing side cut-away view of the invention at open return chamber exhaust and begin valve shift state.
Figure 10:
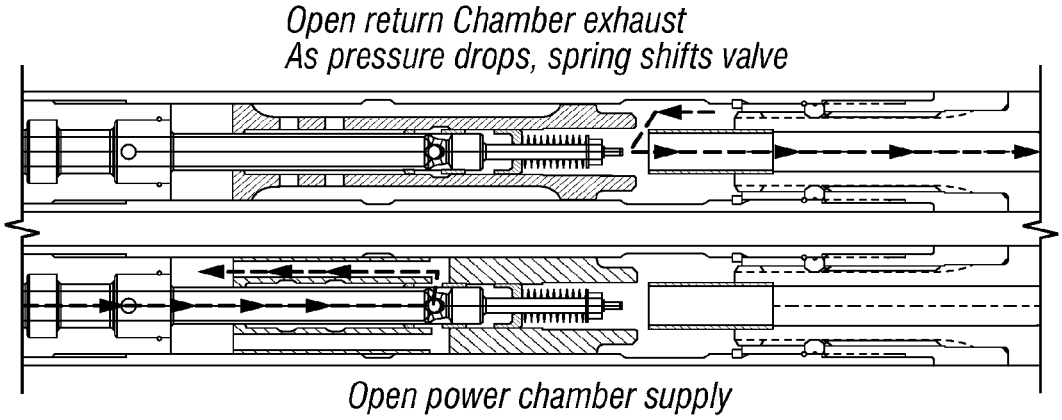
FIG. 10 is a paired opposing side cut-away view of the invention at open power chamber pressure supply state.

The present invention is of a sliding feed tube pressure control valve for reciprocating hammer drills that is more efficient and produces more drilling power. Typically these are pneumatic (air) percussive drills, but could also use other motive fluids (such as water, or gas other than air).

An ideal cycle for maximizing power available from the input air at a given pressure is as follows: 1) during the power stroke, feed high pressure air to the power chamber for the entire duration of the power stroke while simultaneously venting the return chamber to the borehole to minimize the force in the direction opposite the piston motion; and 2) during the return stroke, feed high pressure air to the return chamber for the entire duration of the return stroke while simultaneously venting the power chamber.

Such a cycle would require high precision active valving to sequence air flow to power and return chambers and does not currently exist commercially. Two different air regulation methods are commonly used in industry, both of which involve compromises of the ideal cycle. Both strategies will be briefly discussed in the following.

The approach typically taken by most manufacturers that produce valveless hammers has the following cycle: 1) pressurize the power chamber over a limited distance while venting the return chamber to the borehole; 2) disconnect the power and return chambers from the pressure reservoir and borehole and letting the expanding air in the power chamber continue to accelerate the piston while simultaneously compressing the air in the return chamber; 3) vent the pressure in the power chamber and begin pressurizing the return chamber; and 4) after the piston strikes the bit shank, the pressure in the return chamber moves the piston in the return chamber and the cycle effectively reverses.

The pressurization of the return chamber prior to impact is a significant source of inefficiency in the system, as the working fluid performs work decelerating the piston thereby reducing the energy available to reduce rock. The other deficiency of the valveless approach is a design-limited power stroke pressurization length. Design-limited in this context is used to refer to a limitation imposed by the prescribed length over which pressure is delivered to the return side of the piston. This distance over which pressure is applied to the return side dictates the ultimate return position of the piston thereby fixing the distance over which pressure will be applied during the power stroke. Therefore, in theory, increasing the length of the maximum available power stroke pressurization has no effect on the performance of the system because the return position of the piston will always be limited by the maximum piston velocity produced by rebound and the return stroke pressurization and the distance over which that velocity is brought to zero with opposing pressure. This is somewhat compensated for by increasing the distance over which there is no communication with either the pressure or return chamber thereby utilizing the expansion of the air in the pressure chamber to power the piston.

By contrast, an ideal active valving approach would permit an arbitrary return stroke length by controlling return and power pressurization as desired. One benefit of the valveless design is a reduced part count. The lack of active valving significantly simplifies the design and eliminates the risks associated with valve failure.

The present invention uses a novel valved hammer configuration. The functionality of the sliding valve produces asymmetric timing that is used to provide extended pressurization of the power chamber and reduced pressurization of the return chamber during the power stroke. The valve is housed within the piston and controls the distribution of air from the feed tube to the power or return chamber by covering or exposing ports in the piston.

The valve can be retained and controlled by a spring bias system connected to the feed tube, which is used to limit valve motion and provide a return force to push it away from the bit. This valve retention system results in a relatively small overall valve range of motion (compared to the piston stroke) and considerably lower cycle velocities. Furthermore, valve direction changes are comparatively gradual with no impact loads. Valve position is controlled by the combination of spring force and air pressure acting on the exposed rear (away from the bit) cross-section surface. When no air pressure is acting on the rear valve surface, the spring bias shifts the valve away from the bit. When the piston is in a particular position relative to the valve, air pressure acting on the rear valve face 72 moves it towards the bit, with the consequence of modifying the flow of air from the feed tube to the piston ports.

The shifting of the valve towards the bit can also be accomplished by using a contact surface (e.g., inside shoulder 46 in FIG. 1) on the inside of the piston to push it towards the bit when the inside shoulder engages the valve's rear face 72.

The hammer cycle and valve functionality is described in the cycle steps listed below with reference to the accompanying layout drawings FIGS. 1-11. Return chamber ports and functions are shown in the top view of each layout, while power chamber ports and functions are shown in the bottom view.

FIG. 1 shows a preferred starting configuration of the device 10 according to the invention, comprising: valve 12, stem 14, spring 16, retaining device (e.g., retainer nut) 18, rear return chamber port 20, forward return chamber port 21, power chamber port 22, feed tube 24, exhaust tube 26, external case 28, drill bit shank 30, power chamber 32, power port passageway 34, air feed supply holes 36, piston 38, exhaust chamber 40, return chamber 42, piston forward support section 44, piston internal rear shoulder 46, rear case circumferential cutout 48, forward case circumferential cutout 50, circumferential cutout in piston interior bore 52, feed tube base 54, and upper bit bearing retaining ring 56.

In one embodiment, typical distances are as follows (referenced to the piston strike position at the bit shank): power chamber supply/close point during power stroke, about 1.95" from strike position; power chamber supply/close point during return stroke, about 2.5" from strike position; return chamber supply open/close position during power stroke, about 0.5" from strike position; and return chamber supply open/close position during return stroke, about 1.0" from strike position. In this embodiment, the piston is about 10.5" long and 2.5" outer diameter; and the distance from the feed tube support base 54 to the impact face of bit shank 30 is about 15"; the total length of valve 12 is about 3" and has a diameter about 1"; and the distance the valve travels between its two limiting positions in a cycle is about ¾".

A preferred cycle is as follows:

Begin power stroke (FIG. 2)—The valve 12 is shifted towards the feed tube base 52. Forward valve slot 62 and feed tube slot 64 communicate to supply pressure to power chamber 32. The power chamber port 22 begins to receive air from the feed tube holes 36. The return chamber 40 is exhausted through the exhaust tube 26.

Power stroke. Close return chamber exhaust (FIG. 3)—Continue to supply power chamber 32. Return chamber exhaust 40 is closed.

Power stroke. Close power chamber supply (FIG. 4)—Return chamber exhaust still closed. No communication to either chamber.

Power stroke. Exhaust power chamber (FIG. 5)—No communication to return chamber.

Power stroke (FIG. 6)—Start supplying return chamber 42 when front valve slot 62 overlaps with forward return chamber port 21, and shift valve 12. Pressure on rear valve face 72 causes it to shift toward bit 30. Start valve shift by compressing trapped volume in closed return chamber 42. Power chamber still in exhaust.

Bit strike (FIG. 7)—Piston 38 impacts bit shank 30. Valve 12 shifted towards bit. Pressure still supplied to return chamber. Power chamber still in exhaust.

Return stroke (FIG. 8)—Close return chamber supply (approximately ½" before pressurization began on power stroke). Pressure trapped in piston undercut in return chamber keeps valve shifted towards the bit end. Close power chamber exhaust.

Return stroke (FIG. 9)—Open return chamber exhaust 40. Start separation from exhaust tube 26. As the piston's internal pressure drops, spring 16 will allow valve 12 to shift away from bit 30. No communication to power chamber.

Return stroke (FIG. 10)—Open power chamber supply when rear valve slot 64 overlaps with feed tube supply hole 36 and power chamber port 22. This point is approximately 0.5" farther from the bit than the supply cutoff during the power stroke. The valve shifts and the cycle begins again.

Figure 11:
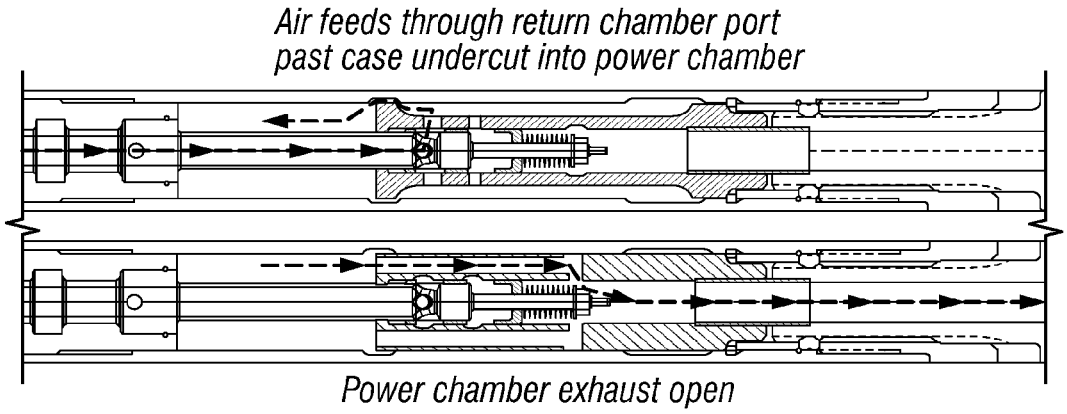
FIG. 11 is a paired opposing side cut-away view of the invention in hole cleaning mode.

The present invention also provides for a hammer exhaust (hole cleaning) mode. Preferably, when the bit is not engaged against the rock, the bit is backed out and adjusted so that air is directly exhausted through the bit, without any piston cycling. This permits cleaning of the hole and prevents damage to the hammer due to impact without energy transfer to the rock. This mode is shown in FIG. 11 and is the reason for the rear case circumferential cutout 48 in the case 28; and is the reason for including the second row of openings (i.e., the rear return supply port 20). In the hole cleaning position, the piston's impact face is seated against the upper bit bearing retaining ring 56 and air flow is through the rear return chamber supply port 20, through the rear case circumferential cutout 48 in the case, to power chamber 32, then back through the piston passageway 34 and power chamber port 22, through the exhaust chamber 40 in exhaust tube 26, and ultimately exhausted out through the central hole in bit 30.

Figure 12:
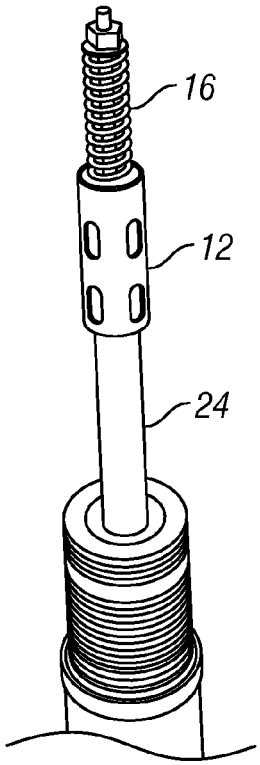
FIG. 12 is a top perspective view of the spring and retaining nut in conjunction with the valve over the feed tube.
Figure 13:
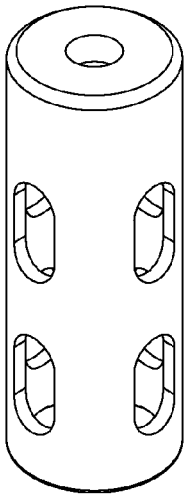
FIG. 13 is a top perspective view of the valve.
Figure 14:
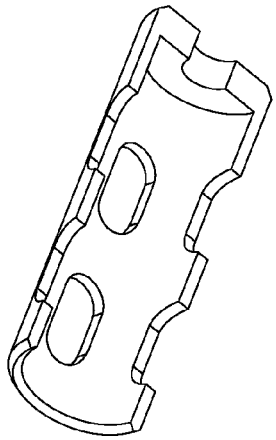
FIG. 14 is a cross-sectional view of the valve.
Figure 17:
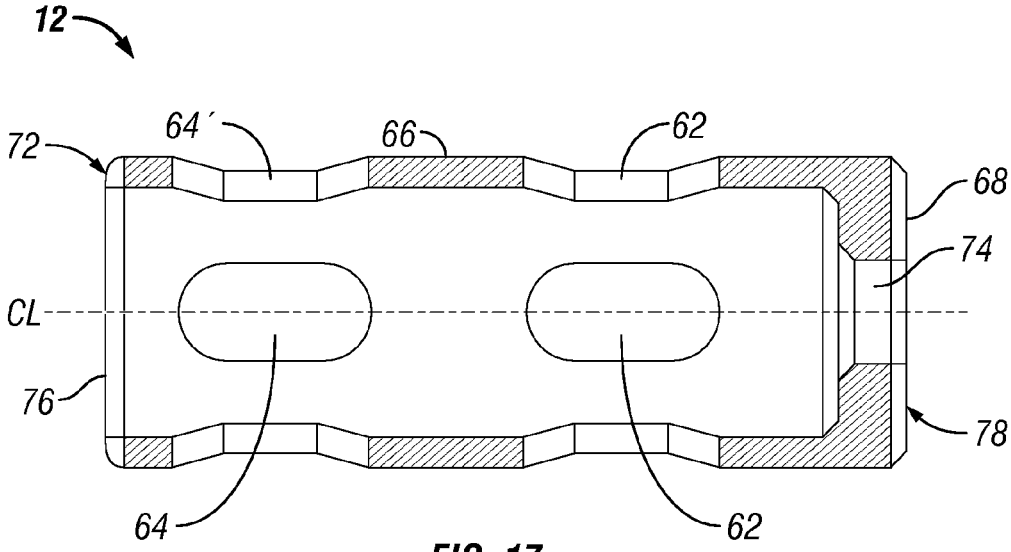
FIG. 17 is a sectional view of the preferred valve of the invention.

The sliding, ported valve of the invention, shown in detail in FIG. 17 and in FIGS. 12-14, is used to control the flow of air from the feed tube in the pneumatic drill to the power and return chambers that motivate a reciprocating piston used to provide impact energy to a bit shank. Valve 12 comprises a hollow cylinder (sleeve or spool) 66 with an open rear end 76, a rear face 72, a closed front end 68, a front face 78, a central hole 74 passing through closed front end 68 (note: hole 74 is sized to fit over stem 14), and a plurality of openings (slots, ports) 62, etc., that can be circular, or elongated along the valve's axial direction.

In one embodiment, the valve comprises a first row of four openings (62, 62', etc), located 90 degrees apart circumferentially. In another embodiment, the valve additionally comprises a second row of four openings (64, 64', etc), located 90 degrees apart circumferentially, wherein the first set of openings is disposed towards the closed front end 68 of cylinder 66, and the second set of openings is disposed towards the open rear end 76 of cylinder 66. Valve 12 can be made of steel, aluminum alloy, lightweight metal, or graphite reinforced epoxy composite, ceramic, etc. Preferably, the valve slides over the feed tube 24 of the drill, and employs a compliant (i.e., spring-like) biasing device (e.g., a coil spring or die spring) on the feed tube for forcing (urging) the valve in a particular direction (i.e., away from the bit) in a compliant manner in order to assume a particular position relative to the air distribution port 36 in the feed tube. Other mechanical variations of a spring bias means, including Belleville washers, wave springs, elastomers, an air cylinder, etc, can be used instead of a coil spring. Additionally, air pressure supplied through the valve, through porting in the piston to the front face 78 of the valve, can also be used to provide the bias force.

The valve also preferably causes the point during the stroke of the piston at which air is delivered through the piston ports to differ on the return stroke from the power stroke. The valve provides the ability to make the timing of air flow to the drill chambers asymmetric with respect to the power and return stroke of the piston. The valve can control the point during the stroke at which air flow from the feed tube to the power chamber is terminated during the power stroke, thereby permitting a termination point that is closer to the piston impact point. This provides for the ability to pressurize the power chamber over a longer extent of the overall stroke (which improves overall efficiency).

Furthermore, the preferred valve controls the point during the stroke at which air flow from the feed tube to the power chamber is initiated during the return stroke, permitting a power chamber pressurization point that is farther from the piston impact point than when air flow was terminated during the power stroke. This provides for the ability to create a greater overall piston stroke by delaying the onset of pressure in the power chamber, during return motion of the piston, which causes it to decelerate when it is moving away from the bit.

The valve also controls the point during the stroke at which air flow from the feed tube to the return chamber is initiated during the power stroke, permitting an initiation point that is closer to the piston impact point. This provides for the ability to delay the pressurization of the return chamber prior to piston impact. Pressurization of the return chamber prior to impact causes the piston to decelerate, reducing the energy transmitted during impact.

Finally, the valve also controls the point during the stroke at which air flow from the feed tube to the return chamber is supplied during the return stroke, thereby permitting a pressure supply point that is farther from the piston impact point than the point at which pressurization was terminated during the power stroke. This provides for the ability to start pressurizing the return chamber closer to the back end during the return stroke, as compared to the power stroke producing a longer overall piston stroke.

In other words, the present sliding valve design provides asymmetric timing (i.e., variable pressure control) of both the power chamber and the return chamber.

One embodiment uses a "spring" bias on the valve's front end 68 (or other means for biasing) to move the valve away from the bit, combined with using air pressure applied to the valve's rear face 72 to move it towards the bit.

Figure 18:
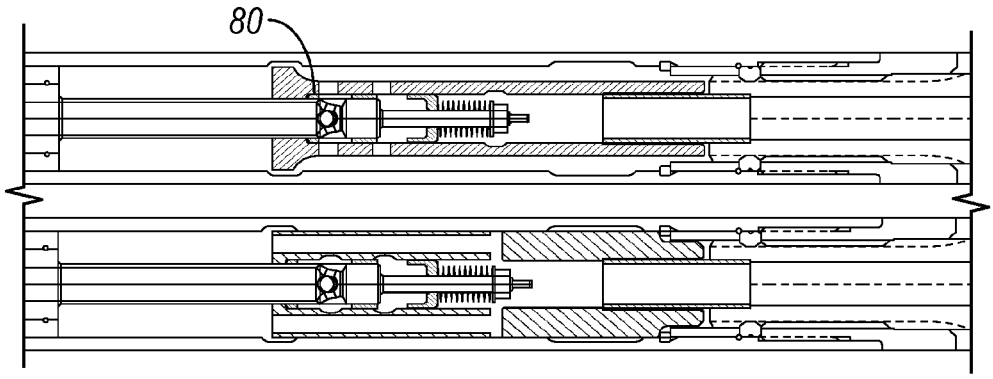
FIG. 18 is a paired opposing side cut-away view of the invention, showing an alternative rear shoulder design.

Another embodiment uses a modified internal shoulder (shoulder 80 in FIG. 18) inside the piston that contacts the valve's rear face 72 and limits the rearward extent of the valve's travel away from the bit. Inner shoulder 80 pushes on the valve's rear face 72 to move it towards the bit.

Piston 38 does not have any internal shoulders that push on the valve's front face 78; relying, instead, on the spring bias means to limit the forward extent of the valve's travel towards the bit end.

Figure 15:
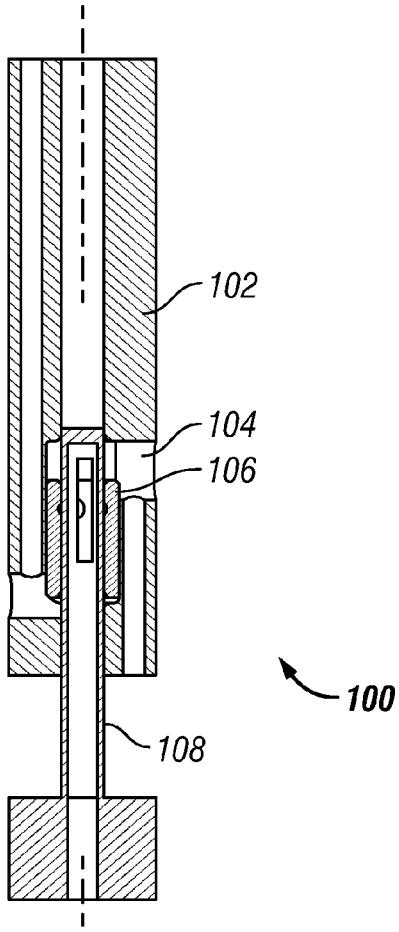
FIG. 15 is a schematic view of an alternative valved device according to the invention.
Figure 16:
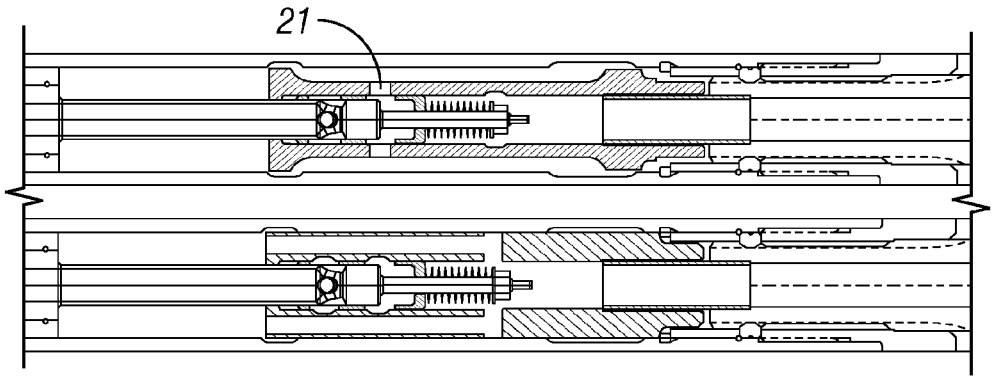
FIG. 16 is a paired opposing side cut-away view of the invention with a single row of openings in the piston.

An alternative device 100 according to the invention is shown in FIG. 15, comprising piston 102, piston port 104, valve 106, and air feed conduit 108. This provides an alternative device that is also a mechanical means of regulating the flow of air or other motive fluid to the power and return chambers of a percussive drilling device; although in principle this regulation scheme can be applied to any application where control over the reciprocation of a piston-like element is desired based on its stroke position. The device provides the ability to regulate the flow air into both the power and return chamber. The mechanical form of the regulating mechanism is a "spool" or a "sleeve" that is positioned between the piston element of the device and air distributor or "feed tube" as it is called in downhole hammer drilling devices. The spool acts to cover and thereby isolate ports that convey motive fluid to the piston power and return chambers and, therefore, behaves much in the same way that a spool valve does in a typical hydraulic or pneumatic control application. The position of the spool is controlled by the application of pressure to its exposed end faces 72 and 78. This pressure is determined by controlled dimensioning of the spool and location of the porting in the air distributor or "feed tube". The piston cross ports (ports perpendicular to the main axis) are oversized slots. The spool does not completely overlap the slots at the ends of its travel thereby permitting flow around it and pressure to be applied to its outside surface to move it when it is at its extremes. The cycle works as follows: (1) Min position during power stroke—pressure on rear supply port forces spool to cover most of forward supply port; (2) Mid position during power stroke—supply to rear chamber continues; (3) Begin rear vent during power stoke—the spool is still blocking forward supply port and rear chamber begins to vent; (4) Shift spool/piston impact (prior to impact)—the feed tube opening begins to supply the non-overlapped area of the forward chamber supply port, which shifts the spool, along with impact, and allows full pressurization of forward chamber—the rear supply port is simultaneously partially blocked changing the point in the stroke at which the feed tube will connect with this port; (5) Continue to supply forward chamber on initiation of return stroke; and (6) Begin rear supply on return stroke—when the feed tube slot passes the spool, the spool shifts to supply the rear chamber and cover the front chamber supply port—this occurs closer to the rear than on the power stroke because of the shifted spool position. The intention of this approach is threefold: (1) to prevent pressurization of forward chamber during power stoke; (2) to increase length of pressurization of rear chamber during power stroke; and (3) to decrease length of pressurization of rear chamber during power stroke (to increase overall stroke length). The spool can be inserted by counter-boring the rear side of the piston, and installing a cap tube to create the confining surface.

Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A pneumatic device control apparatus comprising:

a ported valve slidably fitted over a feed tube of a pneumatic device; and a compliant biasing device operatively connected to and constraining motion of the ported valve and for providing asymmetric timing for extending pressurization of a power chamber of the pneumatic device and for reducing pressurization of a return chamber of the pneumatic device, the compliant biasing device is in a rest position when the ported valve is at a first point along the feed tube and the compliant biasing device is in a non-rest compressed position when the ported valve is at a second point along the feed tube, the second point along the feed tube is closer to a drill bit than the first point along the feed tube.

2. The apparatus of claim 1 wherein said ported valve comprises an open end, a rear face on the open end, a closed end, a front face on the closed end, and a sidewall comprising a plurality of openings.

3. The apparatus of claim 2 wherein said plurality of openings comprises at least one set of two openings spaced apart between said ends.

4. The apparatus of claim 2 wherein said plurality of openings comprises at least two openings on different circumferential portions of said sidewall.

5. The apparatus of claim 4 wherein said plurality of openings comprises at least four openings on different circumferential portions of said sidewall.

6. The apparatus of claim 5 wherein said plurality of openings comprises at least two sets of four openings, each set spaced apart between said ends.

7. The apparatus of claim 1 wherein said compliant biasing device comprises one or more devices selected from the group consisting of a spring, a Belleville washer, an elastomer, and an air cylinder.

8. The apparatus of claim 7 wherein said compliant biasing device comprises a die-spring.

9. The apparatus of claim 1 wherein the pneumatic device is a pneumatic hammer drill, comprising a reciprocating piston configured to cyclically impact the drill bit.

10. The apparatus of claim 9, wherein the reciprocating piston comprises an inner shoulder that contacts a rear face of the ported valve, thereby limiting a rearward position of the ported valve.

11. A method of controlling a pneumatic device comprising the steps of:

slidably fitting a ported valve over a feed tube of the pneumatic device;

constraining motion of the ported valve via a compliant biasing device, and providing asymmetric timing for extending pressurization of a power chamber of the pneumatic device and for reducing pressurization of a return chamber of the pneumatic device; and maintaining the ported valve between a first point along the feed tube and a second point along the feed tube, the compliant biasing device is in a rest position when the ported valve is at the first point and the compliant biasing device is in a non-rest compressed position when the ported valve is at the second point, the second point along the feed tube is closer to a drill bit than the first point along the feed tube.

12. The method of claim 11 wherein the ported valve comprises an open end, a rear face on the open end, a closed end, a front face on the closed end, and a sidewall comprising a plurality of openings.

13. The method of claim 12 wherein the plurality of openings comprises at least one set of two openings spaced apart between the ends.

14. The method of claim 12 wherein the plurality of openings comprises at least two openings on different circumferential portions of the sidewall.

15. The method of claim 14 wherein the plurality of openings comprises at least four openings on different circumferential portions of the sidewall.

16. The method of claim 15 wherein the plurality of openings comprises at least two sets of four openings, each set spaced apart between the ends.

17. The method of claim 11 wherein the compliant biasing device comprises one or more devices selected from the group consisting of a spring, a Belleville washer, an elastomer, and an air cylinder.

18. The method of claim 17 wherein the compliant biasing device comprises a die-spring.

19. The method of claim 11 wherein the pneumatic device is a pneumatic hammer drill with a front end and a back end, and further comprises a reciprocating piston configured to cyclically impact the drill bit located at the front end of the pneumatic device.

20. The method of claim 19, wherein the reciprocating piston comprises an inner shoulder that contacts a rear face of the pneumatic valve, thereby limiting a rearward position of the pneumatic valve.

21. A method of controlling a pneumatic device comprising the steps of:

slidably fitting a ported valve over a feed tube of the pneumatic device; and constraining motion of the ported valve via a compliant biasing device, and providing asymmetric timing for extending pressurization of a power chamber of the pneumatic device and reducing pressurization of a return chamber of the pneumatic device, wherein a reciprocating piston of the pneumatic device has an overall stroke length, and wherein the reciprocating piston cycles between a power stroke portion and a return stroke portion, and wherein the step of providing asymmetric timing comprises using the ported valve to:

a) control a point during the power stroke at which air flow from the feed tube to the power chamber is terminated during the power stroke, thereby permitting a termination point that is closer to the piston impact point, and also providing for the ability to pressurize the power chamber over a longer extent of the overall stroke, which improves overall efficiency;

b) control a point during the return stroke at which air flow from the feed tube to the power chamber is initiated during the return stroke, thereby permitting a power chamber pressurization point that is farther from the piston impact point than when air flow was terminated during the power stroke, and also providing for the ability to create a greater overall piston stroke length by delaying onset of pressure in the power chamber, during return motion of the reciprocating piston, which causes it to decelerate when it is moving away from a drill bit;

c) control a point during the power stroke at which air flow from the feed tube to the return chamber is initiated during the power stroke, thereby permitting an initiation point that is closer to the piston impact point, and also providing for the ability to delay pressurization of the return chamber prior to piston impact; and d) control a point during the return stroke at which air flow from the feed tube to the return chamber is supplied during the return stroke, thereby permitting a pressure supply point that is farther from the piston impact point than a point at which pressurization was terminated during the power stroke, and also providing for the ability to start pressurizing the return chamber closer to the back end during the return stroke, as compared to the power stroke producing a longer overall piston stroke length.

* * * * *